United States Patent [19]

Luttbeg

[11] 4,091,977

[45] May 30, 1978

[54] PROTECTIVE ENCLOSURE

[76] Inventor: Michael B. Luttbeg, 764 Winding Bend La., Manchester, Mo. 63011

[21] Appl. No.: 655,987

[22] Filed: Feb. 6, 1976

[51] Int. Cl.[2] ..... B65D 71/00

[52] U.S. Cl. ..... 224/47; 150/52 E; 150/1.5 R

[58] Field of Search ..... 224/45 R, 47, 45 S, 224/45 Q; 150/52 E, 52 R, 52 G, 1.5 R, 1.5 B, 52 F; 190/41, 42; 206/314, 317, 417, 446, 315 B; 220/17, 15, 23, 259, 71, 72, 85 H, 4 E, 4 B, 6

[56] References Cited

U.S. PATENT DOCUMENTS

| | | | |
|---|---|---|---|
| 1,031,361 | 7/1912 | Mitchell | 150/1.5 R |
| 1,637,538 | 8/1927 | Sampson | 150/1.5 R |
| 2,256,521 | 9/1941 | Kirkpatrick et al. | 150/52 G |
| 2,432,365 | 12/1947 | Allen | 150/52 A |
| 2,624,451 | 1/1953 | Ewing | 220/15 |
| 2,627,887 | 2/1953 | Becker | 150/52 R |
| 2,858,014 | 10/1958 | Koziol | 206/446 |
| 3,038,513 | 6/1962 | Hamlett | 150/52 R |
| 3,316,951 | 5/1967 | Jacobson | 150/1.5 R |
| 3,559,709 | 2/1971 | Seibold | 150/1.5 R |
| 3,729,038 | 4/1973 | Ekeson | 150/52 E |

*Primary Examiner*—Trygve M. Blix
*Assistant Examiner*—Kenneth Nolan
*Attorney, Agent, or Firm*—Rogers, Eilers & Howell

[57] ABSTRACT

A protective carrier for golf bags and golf clubs comprising a tapered, tubular shaped, rigid container having hinged clam shell halves permitting the container to be opened and closed, and a lock and latches to secure the halves. A longitudinal reinforced slot is provided in the container wall to allow the extension of a golf bag handle and golf bag strap through the container to permit carrying of the container and a golf bag therein. A latch strap across the slot prevents the golf bag strap and handle from becoming inaccessible by receding into the interior of the container. Reinforcement ribs can be provided around the slot. The carrier has closed ends formed of hemispherical sections. Supporting ribs can extend longitudinally along the interior of the carrier, or can be arcuate shaped and extended transversely along the interior of the carrier. An alternative embodiment comprises a solid conical shaped slotted tube with an openable plug end and a permanently closed end.

8 Claims, 8 Drawing Figures

PROTECTIVE ENCLOSURE

BACKGROUND OF THE INVENTION

This invention is concerned with protective carrying equipment for golf bags and golf clubs, and is particularly concerned with protective containers for golf bags having handles and straps. Golf bags and clubs are frequently exposed to harsh bending and scraping forces during transit or other handling. Various types of containers for golf clubs are known in the prior art. However, these containers are inadequate for protecting the golf clubs or golf bags in transit or during other handling. Some prior art devices have walls or sides which are composed of non-rigid flexible or loose material, and consequently are inadequate in providing protection for the golf clubs contained in the bag when the bag is subjected to forces during shipment or during other use. Some of the prior art containers are open at one end, and offer no resistance to the ends of golf clubs to prevent them from sliding out of the bag, and becoming exposed to distorting and scraping forces. Other prior art containers are combination golf bag and protective devices which are unwieldy and heavy to carry on a golf course.

Prior art golf bags which are composed of rigid material provide some protection for the clubs during shipping, but are themselves misshapened or scraped, and are consequently an unattractive sight on the golf course or in the club house. Because those bags having protective structure have excessive weight they can be uncomfortable to carry and handle on the golf course. The wear on these rigid golf bags also causes their structural strength to decrease.

Prior art devices used to carry other articles have a bag or handle which is attached to the container itself. There is thus a duplication of handles and straps when such a container is used to carry a golf bag which has a handle or straps. The structure of prior art devices is also inadequate with regard to optimum strength and space, because they are not designed to fit the shape of a golf bag, nor are they designed to have maximum strength while enclosing a golf bag.

SUMMARY OF THE INVENTION

The present invention has advantages over the prior art. The container has a tapered tubular shape which enables it to properly fit the shape of a golf bag, especially those golf bags having a bottom portion which is larger than its top portion. It has hinged clam shell halves or sections which permit it to be easily opened and closed. Because its shape is designed to fit the shape of a golf bag, the bag can be inserted with ease.

There is a longitudinal slot in the side of the tube located at a position which corresponds to the position a strap and handle have when placed inside the container when the tube is closed. The golf bag strap and handle are allowed to project through this slot so that they can be gripped on the outside of the tube. Thus there is no duplication of a strap or handle for carrying the golf bag in the protective container as the golf bag strap and handle can be utilized for this purpose. The container also has a short strap which can be fastened across the longitudinal slot to prevent the golf bag handle and strap from being inadvertently positioned inside the container away from the slotted opening. Because the container itself has no carrying strap, there is little need for reinforcing structure which would be necessary along the position of strap attachment if a carrying strap were present. As the golf bag can be removed from the container after shipment or handling, there is no additional structural weight added to the bag itself which would add to the difficulty of carrying the bag on the golf course or elsewhere.

Closed ends which can have a chordal shape are formed on the ends of the container sections which provide closed ends for the tubular container when the container is shut. The ends can also be circular if desired, e.g., for extra strength. These ends prevent the golf clubs and other items in the golf bag from spilling out of the bag during transit. The protective tubular container can be composed of light material such as plastic or magnesium, and prevents crushing and scraping forces from disfiguring the enclosed golf bag and its contents.

The conical shape of the container gives it strength and durability not found in prior art containers. The container also can have longitudinal or arcuate support ribs along its interior to provide additional resistance to crushing forces. The area around the slot for longitudinal strap and handle can also be reinforced to compensate for the material removed by the slot. Latches are provided for securing the carrier halves shut, and a locking device is provided for additional protection.

A modification of the invention features a solid tubular container having one sealed end and one plugged end which can be removed so as to allow insertion of the golf bag in the container. The golf bag can be inserted so as to be aligned with the longitudinal slot, so that the handle and strap can be pulled through the slot once the bag is inserted. The plug end can then be closed and locked as by a hinge type lock.

DESCRIPTION OF A PREFERRED EMBODIMENT

Figure 1:
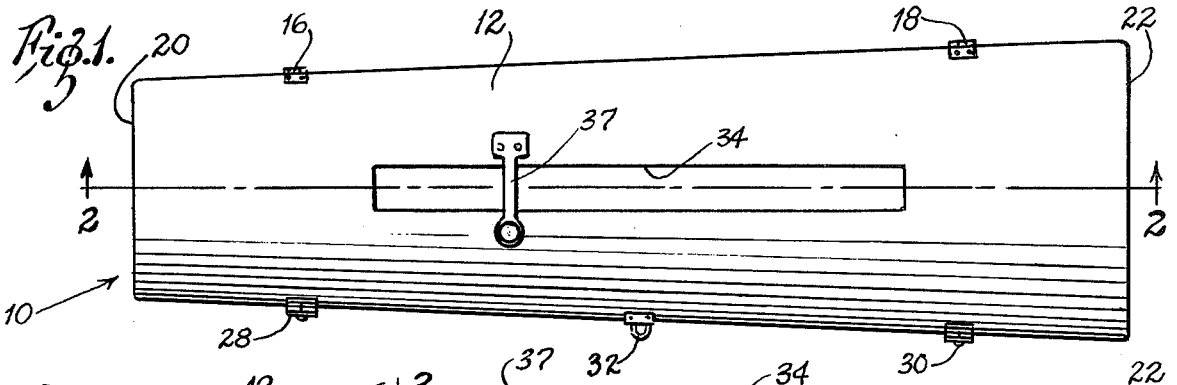
FIG. 1 is a top plan view of the carrier.
Figure 2:
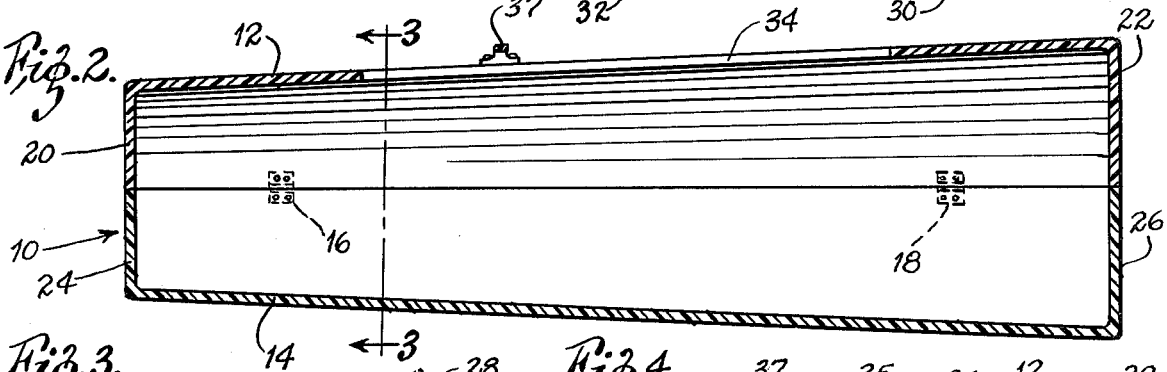
FIG. 2 is a side section view taken on the line 2—2 of FIG. 1.
Figure 3:
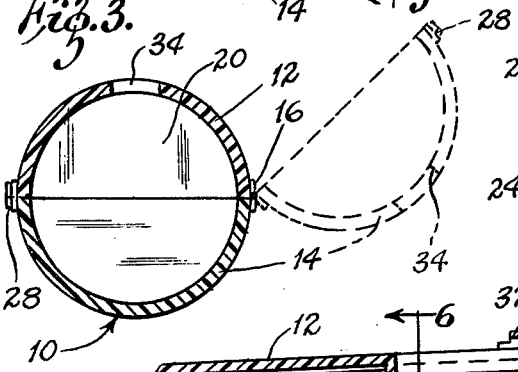
FIG. 3 is an end section view taken in the line 3—3 of FIG. 2, with the open position illustrated with broken lines.

The protective carrier indicated by reference character 10 as shown in FIG. 1, has a tapered tubular body which can be composed of a rigid material such as plastic or magnesium. The tubular body comprises two cylindrical cone sections 12 and 14 which are held together at the edges of each section by hinges 16 and 18. At the end of tubular section 12 are chordal shaped ends 20 and 22 which can be molded integrally with tubular section 12 or can be attached securely to section 12 by an adhesive such as an epoxy or other similar material, or by a weld if the components are metal. Tubular section 14 likewise has two chordal shaped ends 24 and 26 which can be similarly attached to it. When tubular sections 12 and 14 are closed together, sections 20 and 24 and sections 22 and 26 likewise close together to form closed ends for the carrier 10.

Latches 28 and 30 are provided near the edges of carrier sections 12 and 14 opposite hinges 16 and 18, so that the two sections can be secured together when the carrier is in the closed position. A hinge or key lock 32 or other type of lock can be provided to allow increased security.

Figure 4:
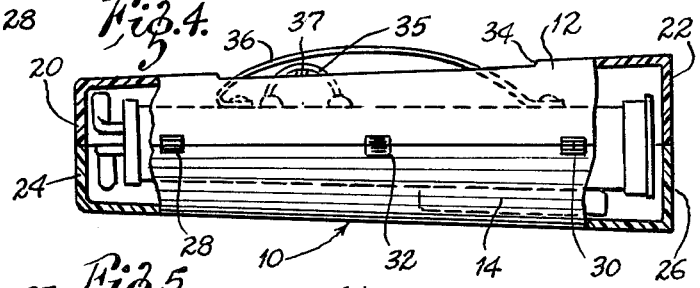
FIG. 4 is a side plan view partially in section showing an enclosed golf bag and the carrier.

A longitudinal slot 34 is formed in the side wall of section 12. Slot 34 should be long and wide enough to allow passage of a conventional golf bag handle 35 and golf bag strap 36, as shown in FIG. 4. Slot 34 is adapted to allow the extension of the golf bag strap 36 and handle 35 through it so that they are exposed for grasping on the outside of the carrier 10. A strap 37 is attached to the outside of the carrier section 12 on one side of slot 34. The other end of strap 37 can be fastened to a buckle or snap or the like on the outside of the carrier on the other side of the slot 34. The strap 37 is adapted to pass underneath the golf bag strap 36 and handle 35 and be fastened to the buckle on the side of the slot after the handle and strap have been extended through slot 34. Strap 37 acts to prevent the handle 35 and bag strap 36 from re-entering the container and thus becoming inaccessible.

Figure 5:
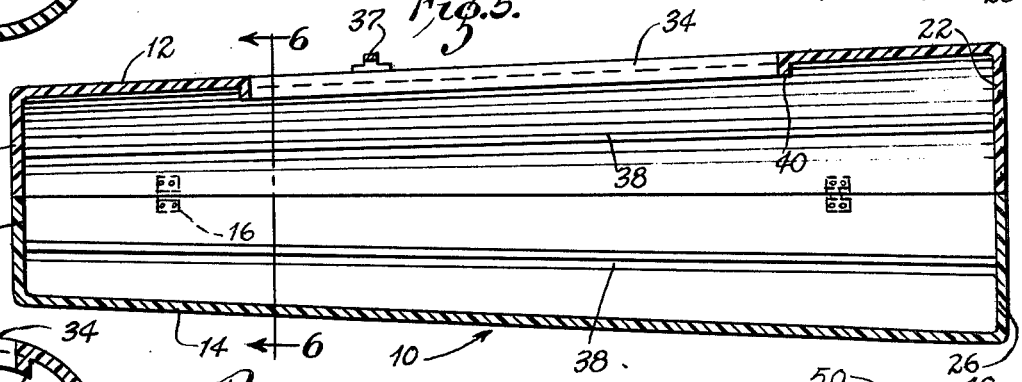
FIG. 5 is a side section view of a modification of the carrier showing support ribs.

As seen in the modification of the invention shown in FIG. 5, supporting longitudinal ribs 38 can be provided on the interior side of the container section 12 and 14 for added strength. The portion of section 12 surrounding slot 34 can also be provided with a supporting section 40 having two side ribs and two end ribs to provide reinforcement around the slot 34.

Figure 8:
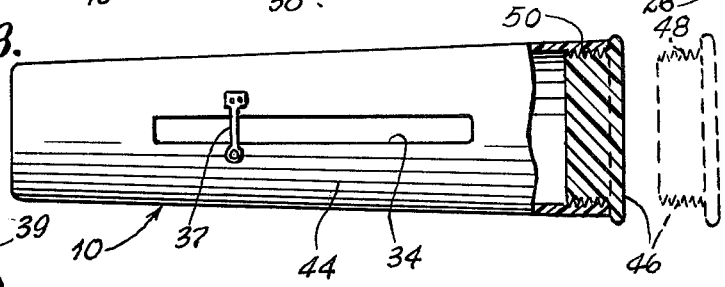
FIG. 8 is a top view partly in section of a modification of the invention, showing bag insertion from the end, and showing the plug end of the carrier in a detached position with broken lines.

Another modified carrier seen in FIG. 8 can be composed of one solid tube rather than being provided with hinged sections. One end of the rigid tube 44 can be integral with tube 44, providing a closed end. The other end of the tube can be a plug end 46 which could be opened so as to permit the golf bag to be slid in from that end of tube 44. This modification would of course also be tapered with the larger end having the plug end 46 to permit ease in inserting the golf bag. The plug end can snap into the end of the carrier 10, or can be externally threaded, at 48, so as to be received by internal threads 50 of carrier 10.

Figure 7:
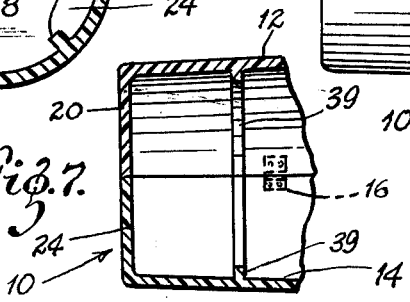
FIG. 7 is a broken side section view showing a modification of the carrier.

In another modification, as shown in FIG. 7, the carrier can have interior arcuate support ribs 39 for sections 12 and 14.

OPERATION

To insert a standard golf bag in container 10, latches 28 and 30, and lock 32, are released so as to permit section 12 to be lifted away from section 14. Container 10 can then be opened as by grabbing its ends with the hands and lifting or inserting a hand into slot 34 and lifting so that section 12 pivots about hinges 16 and 18 and rotates away from section 14. The golf bag can then be inserted so that its larger end is located at the larger end of the tapered portion of section 14. The golf clubs are pushed into the bag so that the bag and the golf clubs fit lengthwise into section 14.

The golf bag is then positioned within section 14 so that its handle 35 and strap 36 will be aligned with slot 34 of section 12 when section 12 is closed. After the golf bag is correctly positioned, the end of strap 37 is fastened. Section 12 is then shut so as to cover the golf bag. In the closed position, the edges of section 12 abut the edges of section 14 and latches 28 and 30 as well as lock 32 can be fastened so that sections 12 and 14 are secured. End sections 20 and 24, and end sections 22 and 26, likewise abut one another in shut position so as to provide closed ends for the container 10.

When the container section 12 is closed on to section 14, the golf bag handle 35 and strap 36 will extend through slot 34. The golf bag strap 36 and handle 35 are pulled through slot 34 so that they are positioned for grasping on the exterior of container 10. Strap 37 is then passed between the golf bag and the golf bag strap 36 and golf bag handle 35. Strap 37 is then fastened to the buckle located at the side of slot 34. In the fastened position, strap 37 prevents the golf bag strap 36 and handle 35 from passing through slot 34 into the container 10, thus becoming inaccessible for grasping.

The golf bag handle 35 or strap 36 can then be grasped so as to carry the bag in the protective container 10. There is no handle on the container 10 itself, and thus the golf bag handle 35 or golf bag strap 35 is utilized to carry the container also. The golf clubs are prevented from sliding out of the container by virtue of the closed ends of the container. The conical shape of the container 10 gives it a naturally strong structure. The rigid surface of container 10 prevents external forces from scraping the golf bag and bending or disfiguring the golf clubs.

After the container 10 and golf bag have been shipped or handled, the container can be opened to allow removal of the bag. Strap 37 is unfastened to permit the golf bag handle and strap to pass through slot 34. Latches 28 and 30, and lock 32 can be opened to permit rotation of section 12 about hinges 16 and 18 to open the container 10. After the container is opened, the golf bag can be grasped by its handle or strap and removed with ease from section 14 of container 10. Container 10 can then be latched, locked and stored as desired.

Figure 6:
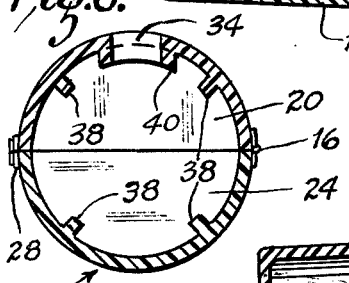
FIG. 6 is an end section view of the modification shown in FIG. 5, taken on line 6—6 of FIG. 5.

The reinforcement ribs 40 around slot 34 shown in the modification of FIGS. 5 and 6 prevents ripping or tearing in the container 10 area surrounding slot 34. The longitudinal ribs 38 provided in the modification of FIGS. 5 and 6 provide additional support along the walls of the container 10.

The arcuate ribs 39 shown in the modification of FIG. 7 also provide for support along the walls of the container 10 of FIG. 7.

In the modification of the invention shown in FIG. 8, the plug end 46 at the larger end of tube 44 is opened so that the golf bag can be slid into the container. The golf bag handle 35 and strap 36 are aligned with the slot 34 in the tube 44 so that the handle 35 and strap 36 can extend through the slot 34 to allow grasping of said strap 36 and handle 35 for carrying. The strap 37 can then be fastened as previously described to prevent the strap 36 and handle 35 from receding within the container 10. The plug end 46 can then be secured to the end of tube 44 by screwing it into the tube 44 if threads 48, 50 are provided on the plug end 46 and tube 44 as discussed previously. With plug end 46 securely attached to tube 44, the golf bag is securely enclosed within the container 10 of FIG. 8.

It will be appreciated that one skilled in the art could modify the disclosed device without departing from the spirit of the invention claimed. The invention herein is not to be limited by the embodiments disclosed for purposes of illustration, but is to be limited only by the scope of the appended claims.

I claim:

1. A protective carrier for shipping and enclosing a golf bag and clubs comprising a rigid molded container having cooperating sections, the closed container having a substantially circular cross-section and being of substantially conical shape, the closed container having an interior space for receiving a golf bag and clubs therein, at least one section of the container having a longitudinal slot therein to receive a carrying element of an enclosed golf bag therethrough, the carrier having cooperating means to retain a carrying element through the slot, the slot having reinforcing means adjacent to the slot, the carrier having a plurality of longitudinally extending reinforcing ribs spaced circumferentially on the carrier to provide increased rigidity and strength to the carrier, the carrier having fastening means for selectively connecting the cooperating sections.

2. The carrier of claim 1 wherein the sections have hinged connecting means.

3. The carrier of claim 1 wherein the container has connecting means including a lock.

4. The carrier of claim 1 wherein the means to retain a carrier element through the slot includes a strap connected to the container on a side of the slot.

5. The carrier of claim 1 wherein the sections are half conical sections having means which form closed ends for the carrier when the sections are in an abutted cooperating position.

6. The carrier of claim 1 wherein one section of the carrier is a conically segmented tube with an end of the tube being a closed end integral with the tube.

7. The carrier of claim 6 wherein the carrier has a second end having a cooperating opening and closure means.

8. The carrier of claim 7 wherein the cooperating opening and closure means is threaded.

* * * * *